US009217623B2

(12) United States Patent
Sovine et al.

(10) Patent No.: US 9,217,623 B2
(45) Date of Patent: Dec. 22, 2015

(54) BULLET DEFLECTING BAFFLE SYSTEM

(71) Applicant: Action Target Inc., Provo, UT (US)

(72) Inventors: James Sovine, Orem, UT (US); Addison Sovine, Orem, UT (US)

(73) Assignee: Action Target Inc., Provo, UT (US)

( * ) Notice: Subject to any disclaimer, the term of this patent is extended or adjusted under 35 U.S.C. 154(b) by 227 days.

(21) Appl. No.: 13/849,886

(22) Filed: Mar. 25, 2013

(65) Prior Publication Data

US 2014/0284881 A1 Sep. 25, 2014

(51) Int. Cl.

| | |
|---|---|
| ***F41J 13/00*** | (2009.01) |
| ***F41H 5/02*** | (2006.01) |
| ***F41J 11/02*** | (2009.01) |

(52) U.S. Cl.

CPC ..... *F41J 13/00* (2013.01); *F41H 5/023* (2013.01); *F41J 11/02* (2013.01)

(58) Field of Classification Search

CPC ..... F41J 11/00; F41J 13/00; F41J 13/02
USPC ..... 273/404, 410; 89/36.02; 403/167, 286, 403/395, 399; 52/461, 463, 464, 468, 281, 52/282.1, 282.5, 394, 395, 52/506.06–508.09; 248/343
See application file for complete search history.

(56) References Cited

U.S. PATENT DOCUMENTS

| | | | |
|---|---|---|---|
| 429,942 | A | 6/1890 | McBride |
| 570,820 | A | 11/1896 | Scratton |
| 631,175 | A | 8/1899 | Parnall |
| 774,959 | A | 11/1904 | Tresidder |
| 840,610 | A | 1/1907 | Easdale |
| 867,406 | A | 10/1907 | Pates |
| 879,670 | A | 2/1908 | Petry |

(Continued)

FOREIGN PATENT DOCUMENTS

| | | |
|---|---|---|
| AU | 127432 | 4/1946 |
| AU | 202340 | 8/1954 |

(Continued)

OTHER PUBLICATIONS

Caswell International Corp., Bullet Trap Design, Circa 2002.

(Continued)

*Primary Examiner* — Mark Graham
(74) *Attorney, Agent, or Firm* — Snow Christensen & Martineau; Randall B. Bateman; Sarah W. Matthews

(57) ABSTRACT

The present invention provides a releasable clamp assembly for supporting one or more bullet deflecting plates, comprising: a first plate holder having a channel for receiving an outer lateral edge of a first deflecting plate; a second plate holder having a channel for receiving an outer lateral edge of a second deflecting plate; and a bridge comprising a bridge connecting the first plate holder and the second plate holder and one or more releasable clamp integral with the bridge, wherein the one or more releasable clamp is adapted to apply a clamping force in a direction substantially perpendicular to the first plate holder channel and second plate holder channel. The releasable clamp assembly, when disposed over the outer lateral edges of the first and second deflecting plate, positions the releasable clamp over the first and second deflecting plate to apply a clamping force to the one or more deflecting plate, thereby holding the releasable clamp assembly in secure engagement with the first and second deflecting plate.

19 Claims, 12 Drawing Sheets

(56) References Cited

U.S. PATENT DOCUMENTS

| | | | | | |
|---|---|---|---|---|---|
| 937,733 | A | | 10/1909 | Worrell | |
| 950,101 | A | | 2/1910 | Green | |
| 960,085 | A | | 5/1910 | Giles | |
| 960,892 | A | | 6/1910 | Gates | |
| 980,255 | A | | 1/1911 | Herms et al. | |
| 1,035,908 | A | | 8/1912 | Richardson | |
| 1,155,717 | A | | 10/1915 | Fouts | |
| 1,199,357 | A | | 9/1916 | Evans, Jr. | |
| 1,207,456 | A | | 12/1916 | Whelan | |
| 1,348,283 | A | | 8/1920 | Koehl | |
| 1,424,632 | A | | 8/1922 | Fenton | |
| 1,540,802 | A | | 6/1925 | Ordway | |
| 1,543,605 | A | | 6/1925 | Gavard | |
| 1,559,171 | A | | 10/1925 | Knowles | |
| 1,657,931 | A | | 7/1926 | Krantz | |
| 1,640,954 | A | | 8/1927 | Mach | |
| 1,724,601 | A | | 8/1929 | Kellogg | |
| 1,738,874 | A | | 12/1929 | Domingo | |
| 1,803,514 | A | | 5/1931 | Thomas | |
| 1,831,289 | A | | 11/1931 | Dally | |
| 1,957,933 | A | | 5/1934 | Brandl | |
| 2,048,155 | A | | 1/1935 | Armantrout | |
| 2,008,359 | A | | 7/1935 | Lamb | |
| 2,039,552 | A | | 5/1936 | Reynolds | |
| 2,054,665 | A | | 9/1936 | Tracy | |
| 2,080,230 | A | | 5/1937 | Ray | |
| 2,085,933 | A | | 7/1937 | Vaughan | |
| 2,103,407 | A | | 12/1937 | Dean | |
| 2,104,171 | A | | 1/1938 | Schwerin | |
| 2,105,784 | A | | 1/1938 | Hagberg | |
| 2,160,225 | A | | 5/1939 | Newman | |
| 2,170,637 | A | | 8/1939 | Hatch et al. | |
| 2,179,471 | A | | 11/1939 | Lee | |
| 2,208,010 | A | | 7/1940 | Whitmore | |
| 2,209,580 | A | | 7/1940 | Sargent | |
| 2,212,982 | A | | 8/1940 | Drain, Jr. et al. | |
| 2,213,402 | A | * | 9/1940 | Lowry | 52/204.57 |
| 2,229,064 | A | * | 1/1941 | Finch | 52/506.06 |
| 2,231,528 | A | | 2/1941 | Daniels | |
| 2,269,490 | A | | 1/1942 | Slick | |
| 2,284,510 | A | | 5/1942 | Cates | |
| 2,290,297 | A | | 7/1942 | Smith | |
| 2,328,197 | A | | 8/1943 | Cowin | |
| 2,344,829 | A | | 3/1944 | McAvoy | |
| 2,350,827 | A | | 6/1944 | Saulnier | |
| 2,372,111 | A | | 3/1945 | Norberg | |
| 2,376,279 | A | * | 5/1945 | Schlenkert | 52/509 |
| 2,410,922 | A | | 11/1946 | Balduf | |
| 2,412,242 | A | | 12/1946 | Beaud | |
| 2,538,118 | A | | 6/1949 | Miller | |
| 2,494,210 | A | | 1/1950 | Robinson | |
| 2,535,280 | A | | 12/1950 | Gartrell | |
| 2,586,958 | A | | 2/1952 | Keller | |
| 2,587,042 | A | | 2/1952 | Haiselup | |
| 2,591,984 | A | | 4/1952 | Walsh | |
| 2,613,934 | A | | 10/1952 | Tabler | |
| 2,628,388 | A | | 2/1953 | Poth | |
| 2,671,538 | A | | 3/1954 | Horowitz | |
| 2,706,634 | A | | 4/1955 | Van Valkenburg | |
| 2,738,094 | A | | 3/1956 | Fowler | |
| 2,809,836 | A | | 10/1957 | Musser | |
| 2,819,903 | A | | 1/1958 | Saunders | |
| 2,838,309 | A | | 6/1958 | Merz et al. | |
| 2,838,592 | A | * | 6/1958 | Feketics | 174/371 |
| 2,855,871 | A | | 10/1958 | Huntington | |
| 2,905,283 | A | * | 9/1959 | Leach | 52/282.5 |
| 2,905,469 | A | | 9/1959 | Taylor | |
| 2,912,013 | A | * | 11/1959 | Freyholdt et al. | 138/160 |
| 2,927,665 | A | | 3/1960 | Hauf | |
| 2,932,860 | A | | 4/1960 | Barth | |
| 2,978,531 | A | | 4/1961 | Appleman | |
| 3,004,644 | A | * | 10/1961 | Hull | 52/506.07 |
| 3,014,725 | A | | 12/1961 | Lewis | |
| 3,032,808 | A | | 5/1962 | Fleming | |
| 3,064,976 | A | | 11/1962 | Kuhn | |
| 3,082,848 | A | * | 3/1963 | Keller | 52/417 |
| 3,087,701 | A | | 4/1963 | Wallace | |
| 3,103,362 | A | | 9/1963 | Elofson | |
| 3,113,773 | A | | 12/1963 | Ripepe | |
| 3,140,874 | A | | 7/1964 | Jensen et al. | |
| 3,233,904 | A | | 2/1966 | Gillam et al. | |
| 3,263,385 | A | | 8/1966 | Pauls | |
| 3,278,667 | A | | 10/1966 | Knox | |
| 3,295,283 | A | * | 1/1967 | Griffith et al. | 52/481.1 |
| 3,323,800 | A | | 6/1967 | Knight | |
| 3,348,843 | A | | 10/1967 | Stanley | |
| 3,359,700 | A | | 12/1967 | Birum | |
| 3,363,900 | A | | 1/1968 | Cadle | |
| 3,385,405 | A | | 5/1968 | Cullen | |
| 3,392,980 | A | | 7/1968 | Ortega | |
| 3,394,526 | A | * | 7/1968 | Engelbrecht | 52/708 |
| 3,398,496 | A | | 8/1968 | Mischke | |
| 3,422,538 | A | | 1/1969 | Panissidi | |
| 3,423,891 | A | | 1/1969 | Burris | |
| 3,423,896 | A | | 1/1969 | Widerby | |
| 3,471,153 | A | | 10/1969 | Baumler | |
| 3,485,405 | A | | 12/1969 | Dement | |
| 3,508,302 | A | | 4/1970 | Settanni | |
| 3,510,133 | A | | 5/1970 | Gretzky | |
| 3,515,388 | A | | 6/1970 | Zachmeier | |
| 3,530,633 | A | | 9/1970 | Scott | |
| 3,540,729 | A | | 11/1970 | Rahberger | |
| 3,601,353 | A | | 8/1971 | Dale | |
| 3,614,102 | A | | 10/1971 | Nikoden, Sr. | |
| 3,619,437 | A | | 11/1971 | McDonald | |
| 3,715,843 | A | | 2/1973 | Ballinger | |
| 3,720,411 | A | | 3/1973 | De Vogelaere | |
| 3,748,793 | A | * | 7/1973 | Tompkins et al. | 52/64 |
| 3,802,098 | A | | 4/1974 | Sampson et al. | |
| 3,914,879 | A | | 10/1975 | Taylor, III | |
| 3,927,500 | A | | 12/1975 | Plumlee | |
| 3,969,855 | A | | 7/1976 | Lendi | |
| 3,992,007 | A | | 11/1976 | Seeman | |
| 4,027,454 | A | * | 6/1977 | Schuplin | 52/714 |
| 4,028,856 | A | | 6/1977 | Dalbec | |
| 4,062,164 | A | * | 12/1977 | Cousins | 52/506.07 |
| 4,072,313 | A | | 2/1978 | Murso et al. | |
| 4,076,247 | A | | 2/1978 | Kim et al. | |
| 4,084,299 | A | | 4/1978 | Noda | |
| 4,086,711 | A | | 5/1978 | Gammarino et al. | |
| 4,177,835 | A | | 12/1979 | Paley | |
| 4,205,847 | A | | 6/1980 | Steiger et al. | |
| 4,228,569 | A | | 10/1980 | Snyder | |
| 4,232,867 | A | | 11/1980 | Tate, Sr. | |
| 4,254,600 | A | | 3/1981 | Zwissler | |
| 4,288,080 | A | | 9/1981 | Laporte et al. | |
| 4,294,452 | A | | 10/1981 | Schlotter et al. | |
| 4,317,572 | A | | 3/1982 | Iseli | |
| 4,340,370 | A | | 7/1982 | Marshall et al. | |
| 4,361,330 | A | | 11/1982 | Scharer | |
| 4,395,045 | A | | 7/1983 | Baer | |
| 4,440,399 | A | | 4/1984 | Smith | |
| 4,455,803 | A | * | 6/1984 | Kornberger | 52/395 |
| 4,501,427 | A | | 2/1985 | Payne | |
| 4,506,416 | A | | 3/1985 | Ohminato et al. | |
| 4,540,182 | A | | 9/1985 | Clement | |
| 4,546,984 | A | | 10/1985 | Towle et al. | |
| 4,567,100 | A | | 1/1986 | Pickett et al. | |
| 4,599,831 | A | * | 7/1986 | Magaha, Jr. | 52/98 |
| 4,614,345 | A | | 9/1986 | Doughty | |
| 4,657,261 | A | | 4/1987 | Saunders | |
| 4,691,925 | A | | 9/1987 | Scholem | |
| 4,706,963 | A | | 11/1987 | Geuss | |
| 4,723,749 | A | | 2/1988 | Carraro et al. | |
| 4,726,593 | A | | 2/1988 | Wade | |
| 4,739,996 | A | | 4/1988 | Vedder | |
| 4,743,032 | A | | 5/1988 | Summers et al. | |
| 4,807,888 | A | | 2/1989 | Pidde | |
| 4,844,476 | A | | 7/1989 | Becker | |
| 4,854,248 | A | * | 8/1989 | Salzer | 109/79 |
| 4,890,847 | A | | 1/1990 | Cartee et al. | |
| 4,891,920 | A | * | 1/1990 | Pingston | 52/145 |
| 4,898,391 | A | | 2/1990 | Kelly et al. | |
| 4,911,453 | A | | 3/1990 | Essex et al. | |

(56) References Cited

U.S. PATENT DOCUMENTS 4,913,389 A 4/1990 McCracken
4,937,994 A * 7/1990 Ritter ..... 52/506.07
4,953,875 A 9/1990 Sudit
4,967,530 A * 11/1990 Clunn ..... 52/506.08
4,979,752 A 12/1990 Fosseen
5,040,802 A 8/1991 Wojcinski et al.
5,050,363 A 9/1991 Fornell
5,054,723 A 10/1991 Arnold
5,127,340 A 7/1992 Maro et al.
5,145,133 A 9/1992 France
5,163,689 A 11/1992 Bateman
5,170,604 A 12/1992 Hedly
5,213,336 A 5/1993 Bateman
5,232,227 A 8/1993 Bateman
5,240,258 A 8/1993 Bateman
5,242,172 A 9/1993 Bateman
5,263,721 A 11/1993 Lowrance
5,277,432 A 1/1994 Bateman
5,316,479 A 5/1994 Wong et al.
5,324,043 A 6/1994 Estrella
5,346,226 A 9/1994 Block
5,350,180 A 9/1994 Acock
5,352,170 A 10/1994 Condo et al.
5,361,455 A 11/1994 Kiefer
5,366,105 A 11/1994 Kerman et al.
5,400,692 A 3/1995 Bateman
5,423,150 A 6/1995 Hitchcock
5,433,451 A 7/1995 De Vries
5,456,155 A * 10/1995 Myrtoglou ..... 273/410
5,535,662 A * 7/1996 Bateman ..... 273/410
5,579,794 A 12/1996 Sporta
5,592,789 A 1/1997 Liddell, Sr. et al.
5,598,996 A 2/1997 Rath
5,600,084 A 2/1997 Gonzalez
5,603,193 A * 2/1997 Koertge et al. ..... 52/506.07
5,605,335 A 2/1997 Simpson
5,618,044 A 4/1997 Bateman
5,621,950 A 4/1997 White
5,636,995 A 6/1997 Sharpe, III et al.
5,641,288 A 6/1997 Zaenglein, Jr.
5,648,794 A 7/1997 Jelsma et al.
5,649,706 A 7/1997 Treat, Jr. et al.
5,663,520 A 9/1997 Ladika et al.
5,670,734 A 9/1997 Middione et al.
5,676,378 A 10/1997 West
5,684,264 A 11/1997 Cassells et al.
5,695,196 A 12/1997 Yanosky
5,748,072 A 5/1998 Wang
5,749,177 A 5/1998 Pontus et al.
5,749,671 A 5/1998 Chauquet
5,752,835 A 5/1998 Whitmer
5,765,832 A 6/1998 Huff
5,779,068 A 7/1998 Whiten et al.
5,791,090 A 8/1998 Gitlin et al.
5,802,460 A 9/1998 Parvulescu et al.
5,811,718 A 9/1998 Bateman
5,822,936 A * 10/1998 Bateman ..... 52/281
5,829,753 A 11/1998 Wiser
5,860,251 A 1/1999 Gleich
5,865,439 A 2/1999 Marcuson
5,906,493 A 5/1999 Bishop
5,906,552 A 5/1999 Padilla
5,907,930 A 6/1999 Ricco
5,915,449 A 6/1999 Schwartz
5,934,678 A 8/1999 Theissen et al.
5,947,477 A 9/1999 Turnipseed
5,950,283 A 9/1999 Sato
5,951,016 A 9/1999 Bateman
5,963,624 A 10/1999 Pope
5,967,523 A 10/1999 Brownlee
5,988,645 A 11/1999 Downing
5,988,647 A 11/1999 Porter et al.
6,009,790 A 1/2000 Tekorius
6,018,847 A 2/2000 Lu
6,027,120 A 2/2000 Wojcinski et al.
6,109,614 A 8/2000 Ciarcia
6,179,620 B1 1/2001 Schmid
6,223,029 B1 4/2001 Stenman et al.
6,230,214 B1 5/2001 Liukkonen et al.
6,283,756 B1 9/2001 Danckwerth et al.
6,286,269 B1 9/2001 Marcum
6,289,213 B1 9/2001 Flint et al.
6,308,062 B1 10/2001 Chien et al.
6,311,980 B1 11/2001 Sovine et al.
6,322,444 B1 11/2001 Matsui et al.
6,325,376 B1 12/2001 Elliott et al.
6,328,651 B1 12/2001 Lebensfeld et al.
6,332,243 B1 12/2001 Kim
6,378,870 B1 4/2002 Sovine
6,398,215 B1 6/2002 Carroll
6,415,557 B1 7/2002 McCalley
6,438,906 B1 8/2002 Komarowski et al.
6,449,917 B1 * 9/2002 Sullivan, III ..... 52/506.06
6,453,621 B1 9/2002 Bundy, Jr. et al.
6,463,299 B1 10/2002 Macor
6,478,301 B1 11/2002 Witmeyer
6,484,990 B1 11/2002 Marshall
6,502,820 B2 1/2003 Slifko
6,533,280 B1 3/2003 Sovine et al.
6,543,778 B2 4/2003 Baker
6,547,483 B2 * 4/2003 Rae-Smith ..... 403/403
6,575,753 B2 6/2003 Rosa et al.
6,588,759 B1 * 7/2003 Bateman ..... 273/407
6,679,795 B2 1/2004 Ouimette et al.
6,718,596 B2 4/2004 Kohlstrand et al.
6,722,195 B2 4/2004 Duke
6,728,546 B1 4/2004 Peterson et al.
RE38,540 E 6/2004 Bateman
6,761,357 B2 7/2004 Witt
6,776,418 B1 8/2004 Sovine et al.
6,808,177 B2 10/2004 Dehart
6,808,178 B1 10/2004 Sovine
6,845,701 B2 1/2005 Drackett
6,865,852 B2 3/2005 Gower
6,877,988 B2 4/2005 Phillips et al.
6,896,267 B1 5/2005 Le Anna
6,975,859 B1 12/2005 Lambert et al.
6,994,347 B2 2/2006 Tessel et al.
6,994,348 B2 2/2006 Lambert et al.
6,994,349 B2 2/2006 Lambert et al.
7,074,043 B1 7/2006 Jacobson
7,117,645 B2 10/2006 Bzorgi
7,134,977 B2 11/2006 Campbell et al.
7,140,615 B1 11/2006 Sovine et al.
7,175,181 B1 2/2007 Bateman et al.
7,194,944 B2 3/2007 Lambert et al.
7,201,376 B2 4/2007 Kuosa
7,219,897 B2 5/2007 Sovine et al.
7,234,890 B1 * 6/2007 Marshall et al. ..... 403/408.1
7,264,246 B2 9/2007 Sovine et al.
7,275,748 B2 10/2007 Lambert et al.
7,303,192 B2 12/2007 Marshall et al.
7,306,230 B2 12/2007 Lambert et al.
7,322,771 B1 1/2008 Marshall et al.
7,427,069 B2 9/2008 Bateman et al.
7,431,302 B2 10/2008 Bassett et al.
7,469,903 B2 12/2008 Marshall et al.
7,503,250 B2 3/2009 Lambert et al.
7,556,268 B2 7/2009 Bateman et al.
7,653,979 B2 2/2010 Bateman et al.
7,775,526 B1 8/2010 Lambert et al.
7,793,937 B2 9/2010 Bateman et al.
8,313,103 B2 11/2012 O'Neal et al.
8,414,067 B2 * 4/2013 Howard et al. ..... 296/193.04
8,615,947 B2 * 12/2013 Underkofler et al. ..... 52/506.06
2002/0088339 A1 7/2002 Koffler
2005/0022658 A1 * 2/2005 Bateman et al. ..... 89/36.01
2005/0050816 A1 3/2005 Manning et al.
2006/0151770 A1 7/2006 Payne
2006/0234069 A1 10/2006 Sovine et al.
2006/0240388 A1 10/2006 Marshall et al.
2006/0240391 A1 10/2006 Sovine et al.
2006/0290063 A1 12/2006 Hagar
2006/0290064 A1 12/2006 Hagar

(56) References Cited

U.S. PATENT DOCUMENTS

| | | | | |
|---|---|---|---|---|
| 2007/0072537 | A1 | 3/2007 | Bateman et al. | |
| 2007/0102883 | A1 | 5/2007 | Parks et al. | |
| 2008/0010932 | A1 | 1/2008 | Elliott et al. | |
| 2008/0314237 | A1 | 12/2008 | Cioffi | |
| 2011/0037227 | A1 | 2/2011 | O'Neal et al. | |
| 2011/0062667 | A1 | 3/2011 | Medina et al. | |
| 2011/0233869 | A1 * | 9/2011 | John et al. | 273/410 |
| 2012/0274028 | A1 | 11/2012 | Sudbeck et al. | |

FOREIGN PATENT DOCUMENTS

| | | | |
|---|---|---|---|
| CA | 2100631 | | 2/1994 |
| CH | 597 451 | | 4/1978 |
| DE | 227 342 | | 10/1910 |
| DE | 498 308 | | 5/1930 |
| DE | 514 123 | | 12/1930 |
| DE | 877 489 | | 5/1953 |
| DE | 20 21 170 | | 11/1971 |
| DE | 36 35 741 | | 7/1992 |
| EP | 2343218 | A1 | 7/2011 |
| FR | 832.754 | | 10/1938 |
| FR | 849.829 | | 12/1939 |
| FR | 1.156.211 | | 5/1958 |
| FR | 2.461.069 | | 7/1980 |
| GB | 280832 | | 11/1927 |
| GB | 725189 | | 3/1955 |
| GB | 2136932 | | 9/1984 |
| GB | 2 187 270 | | 9/1987 |
| JP | 6015635 | | 2/1994 |
| KR | 10-2010-0013235 | | 2/2011 |
| NL | 7700295 | | 7/1978 |

OTHER PUBLICATIONS

Caswell International Corp., Bullet Trap Product Literature, Circa 2002.
Caswell International Corp., Product Literature, Copyright 2002.
Declaration of Kyle Bateman re Bullet Trap Design Circa 2001.
Duelatron, Product Literature 1995.
www.letargets.com. Breach training door. Circa 2005.
www.mgmtargets.com. Breach training door Circa 2005.
Porta Target, Product Literature, Circa 2000.
Porta Target, Shoot House Product Literature, Circa 2000.
Savage Arms, Shoot House Bid and Specification, Bid dated Oct. 1998.
ST Bullet Containment Sytems, Inc. Product Literature, Circa 2002.
Trussed Concrete Steel Co., Youngstown, Ohio, Copyright 1903, Product Literature.
Law Enforcement Targets, Inc., Product Literature, Jul. 8, 2003.
Law Enforcement Targets, Inc., Product Literature, Oct. 12, 2004.
Law Enforcement Targets, Inc., Product Literature, Jun. 26, 2007.
Metal Spinning Target, Inc., Dueling Trees, Jul. 8, 2003.
Mike Gibson Manufacturing, Dueling Tree, Jul. 8, 2003.
Outwest Mfg. Products, Product Literature, Jul. 8, 2003.
Shootrite, Tactical Training Target, published prior to Apr. 4, 2005.
International Search Report and Written Opinion from related PCT Application No. PCT/US14/31631, Aug. 8, 2014.
International Preliminary Report on Patentability from PCT Patent Application No. PCT/US2012/022434, Jun. 28, 2013.

* cited by examiner

BULLET DEFLECTING BAFFLE SYSTEM

FIELD OF INVENTION

The present invention relates to bullet deflecting systems, and more particularly to modularly fabricated bullet deflecting systems.

BACKGROUND

Interconnect systems for modularly fabricated baffles and other bullet stops are known in the art. Typically, such systems include a plurality of bulletproof plates which are placed adjacent one another to form a seam, which is covered by a backing strip, and the assembly is bolted together. As shown in U.S. Pat. No. 5,822,936, for example, the bulletproof plates are joined together by such means as a plurality of bolts extending through the backing strip and through a backing mechanism positioned on an opposite side of the plates. When the bolts are tightened, the backing strip and backing pull towards one another and hold the plates together.

The various embodiments of the present invention represent an improvement upon the interconnect systems of the prior art.

SUMMARY OF INVENTION

The present invention includes an apparatus and method for holding bullet deflecting plates adjacent one another to form a bullet deflecting structure, such as, for example, a baffle.

In one aspect, the present invention provides an inexpensive way of holding a plurality of deflecting plates together without the need for welds or the formation of holes in the plates.

In one aspect, the present invention may provide a releasable clamp assembly for supporting one or more bullet deflecting plates which may include, for example:

a first plate holder having a channel configured to receive an outer lateral edge of a first deflecting plate;

a second plate holder having a channel configured to receive an outer lateral edge of a second deflecting plate; and a bridge comprising a bridge connecting the first plate holder and the second plate holder and one or more releasable clamp disposed along the bridge, wherein the one or more releasable clamp is configured to apply a clamping force in a direction generally perpendicular to the first plate holder channel and second plate holder channel. The releasable clamp assembly, when disposed over the outer lateral edges of the first and second deflecting plate, may position the releasable clamp over the first and second deflecting plate to apply a clamping force to the one or more deflecting plate, thereby holding the releasable clamp assembly in secure engagement with the first deflecting plate and the second deflecting plate.

In another aspect, the present invention a modular bullet deflecting baffle system which, when assembled, may include:

a first deflecting plate having an outer lateral edge and an inner lateral edge, and a second deflecting plate having an outer lateral edge and an inner lateral edge, wherein the first deflecting plate and second deflecting plate are positioned such that the inner lateral edge of the first deflecting plate and the inner lateral edge of the second deflecting plate abut each other to form abutting lateral edges and the outer lateral edges of the first and second deflecting plates are generally flush;

a backing strip disposed along and covering the abutting lateral edges of the first deflecting plate and second deflecting plate;

the releasable clamp assembly comprising:

a first plate holder having a channel configured to receive the outer lateral edge of the first deflecting plate;

a second plate holder having a channel configured to receive the outer lateral edge of the second deflecting plate; and a bridge connecting the first plate holder and the second plate holder and comprising one or more releasable clamp positioned to apply a clamping force in a direction generally perpendicular to the first plate holder channel and second plate holder channel;

wherein the releasable clamp assembly is disposed over the outer lateral edges of the deflecting plates, spanning the abutting lateral edges of the first and second deflecting plates, with the first plate holder channel receiving a portion of the first deflecting plate adjacent the outer lateral edge of the first deflecting plate and the second plate holder channel receiving the a portion of the second deflecting plate adjacent the outer lateral edge of the second deflecting plate. The releasable clamp may apply a clamping force to the backing strip, thereby holding the backing strip in secure engagement with the abutting lateral edges of the first and second deflecting plates, and holding the first and second deflecting plates in rigid connection with one another to form a continuous bullet resistant joint.

In yet another aspect, the present invention provides a method for constructing a modular bullet deflecting device which may include, for example:

(a) providing a first deflecting plate having an outer lateral edge and an inner lateral edge, and a second deflecting plate having an outer lateral edge and an inner lateral edge, (b) positioning the first deflecting plate adjacent the second deflecting plate, such that the inner lateral edge of the first deflecting plate and the inner lateral edge of the second deflecting plate abut each other to form abutting lateral edges and the outer lateral edges of the first and second deflecting plates are flush;

(c) positioning a backing strip along and covering the abutting lateral edges of the first deflecting plate and second deflecting plate;

(d) positioning a releasable clamp assembly over the outer lateral edges of the deflecting plates and spanning the abutting lateral edges of the first and second deflecting plates, wherein the releasable clamp assembly may include;

a first plate holder having a channel receiving the outer lateral edge of the first deflecting plate;

a second plate holder having a channel receiving the outer lateral edge of the second deflecting plate; and a bridge connecting the first plate holder and the second plate holder and comprising one or more releasable clamp adapted to apply a clamping force in a direction perpendicular to the first plate holder channel and second plate holder channel; and (d) engaging the releasable clamp to apply a clamping force to the backing strip, thereby holding the backing strip in secure engagement with the abutting lateral edges of the first and second deflecting plates, and holding the deflecting plates in rigid connection with one another to form a continuously bullet resistant joint.

In one embodiment, the channel of the first plate holder and the channel of the second plate holder may be coplanar to accommodate first and second deflecting plates that are coplanar. In another embodiment, the channel of the first plate holder and the channel of the second plate holder may be non-coplanar to accommodate first and second deflecting plates that are at an angle to one another.

In another embodiment, one or more of the first and second plate holder may include a hanging harness for securing a hanging wire to the plate holder.

In another embodiment, the hanging harness may include a wire bolt fastened to the plate holder. In another embodiment, a hanging wire is disposed through the wire bolt.

In another embodiment, one or more of the first plate holder and the second plate holder may include one or more holes for securing fascia to the plate holder with a fastener. In another embodiment, fascia may be secured to the plate holder by fasteners inserted through the plate holder holes and into the fascia. In another embodiment, a frame is secured to the plate holder by fasteners inserted through the plate holder holes and into the frame.

In yet another embodiment, the releasable clamp may include a threaded hole through the bridge and a threaded bolt disposed within the threaded hole, such that screwing the bolt through the hole results in the bolt (or a structure engaging the bolt) applying force to the backing strip and to the deflecting plates. In yet another embodiment, the releasable clamp may include a threaded nut that is attached so that the hole of the nut is positioned over an open hole through the bridge and a threaded bolt disposed within the threaded nut, In another embodiment, the first plate holder further may include a second channel for receiving the outer edge of a third deflecting plate, and the second plate holder may include a second channel for receiving the outer lateral edge of a fourth deflecting plate. In another embodiment, the clamp assembly further comprises a second bridge connecting the first plate holder and the second plate holder, and a second releasable second clamp positioned on the second bridge to apply a clamping force in a direction generally perpendicular to the second channel. In another embodiment, the second channel of the first plate holder and the second channel of the second plate holder may be coplanar. In another embodiment, the second channel of the first plate holder and the second channel of the second plate holder may be transverse, for example, at an angle to one another or at a perpendicular angle.

In another embodiment, the first and second channels of the first plate holder may overlap, and the first and second channels of the second plate holder may overlap, whereby the first and second deflecting plates overlap the third and fourth deflecting plates.

BRIEF DESCRIPTION OF DRAWINGS

Various embodiments of the present invention are shown and described in reference to the numbered drawings, wherein.

DESCRIPTION

Figure 1:
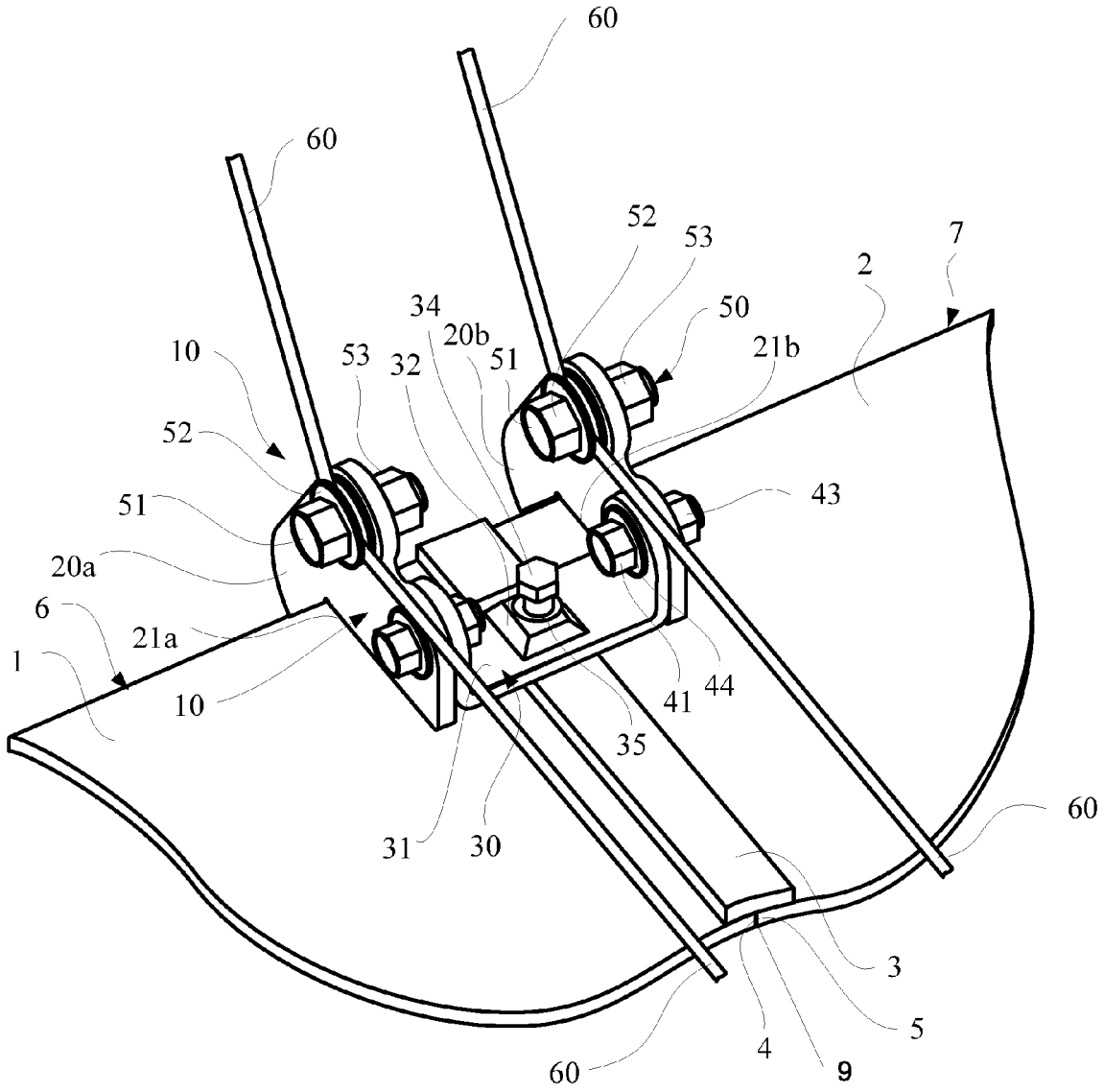
FIG. 1 shows a perspective view of an embodiment of a releasable clamp assembly holding two deflecting plates together at the top of the two plates.

The invention and accompanying drawings are discussed below, using reference numerals to identify parts and features, to enable one skilled in the art to practice the present invention. The drawings and descriptions are exemplary of various aspects of the invention and are not intended to limit or narrow the scope of the appended claims.

Furthermore, it will be appreciated that the drawings may show aspects of the invention in isolation and the elements in one figure may be used in conjunction with elements shown in other figures.

Reference in the specification to "one embodiment," "an embodiment," or "one aspect of the invention" means that a particular feature, structure, step or characteristic described in connection with the embodiment or aspect of the invention is included in at least one embodiment or aspect of the invention and not necessarily that it is present or required in all embodiments or aspects of the invention.

Furthermore, the described features, structures, steps or characteristics of embodiments or aspects of the invention may be combined in any suitable manner in one or more embodiments. In the following description, numerous specific details are provided, such as examples of products or manufacturing techniques that may be used, to provide a thorough understanding of embodiments of the invention. One skilled in the relevant art will recognize, however, that embodiments of the invention may be practiced without one or more of the specific details, or with other methods, components, materials, and so forth. In other instances, well-known structures, materials, or operations are not shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect must be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a spring" may include one or more of such springs, and reference to "the layer" may include reference to one or more of such layers.

As used herein, the term "substantially" or "generally" refers to the complete or nearly complete extent or degree of an action, characteristic, property, state, structure, item, or result to function as indicated. For example, an object that is "substantially" enclosed would mean that the object is either completely enclosed or nearly completely enclosed. Likewise, a reference that something is generally perpendicular would mean that the object is sufficiently perpendicular to carry out a particular function. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" and "generally" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The clamp assembly of the present invention is designed to simplify the installation and construction of modular bullet deflecting baffle systems and the like which may include such materials as metal, which are typically very heavy and difficult to handle. The present invention relates generally to a releasable clamp assembly for supporting one or more bullet deflecting plates. In one aspect, the releasable clamp assembly may include a first plate holder having a channel for receiving a lateral edge of a first deflecting plate and a second plate holder having a channel for receiving a lateral edge of a second deflecting plate. The first and second plate holders may be connected by a bridge. The bridge comprises a releasable clamp, which may be positioned to apply a clamping force to the deflecting plates, in a direction perpendicular to the coplanar channels of the first and second plate holders, thereby holding the clamp assembly in secure engagement with the deflecting plates.

In another aspect, the present invention generally relates to a modular bullet deflecting baffle system which may have one or more deflecting plates having a first outer lateral edge for receiving a releasable clamp assembly. The system may further include a backing strip disposed along and covering the abutting edges of the deflecting plates. A releasable clamp assembly may be used to clamp down on the backing strip, which in turn clamps down on the one or more deflecting plates, while holding the deflecting plates together. The clamp assembly may also be used as an attachment point for a wiring harness for supporting the deflecting plates from a structure, such as a ceiling, by means of a wire, cable, or rope. The releasable clamp assembly may include at least one plate holder having a channel for receiving the outer lateral edge of a deflecting plate. The releasable clamp may also include a bridge connecting the first and second plate holder. The bridge may include a releasable clamp for clamping the releasable clamp assembly to the deflecting plate and the backing strip. The releasable clamp assembly may be disposed over the outer lateral edge of the deflecting plate and span the second lateral edge of the deflecting plate. Alternatively, the releasable clamp assembly may be positioned so that one or more of the plate holders are disposed over a single deflecting plate without extending over the other lateral edge of the deflecting plate, for example, at the outer corner of a terminal plate, or the middle of a plate. The plate holder channel may receive the first lateral edge of the deflecting plate, and the releasable clamp applies a clamping force to the backing strip, thereby holding the backing strip in secure engagement with the deflecting plate.

In yet another aspect, the present invention provides a method for constructing a modular bullet deflecting device which may include: (a) providing a first deflecting plate having an outer lateral edge and an inner lateral edge, and a second deflecting plate having an outer lateral edge and an inner lateral edge, (b) positioning the first deflecting plate adjacent the second deflecting plate, such that the inner lateral edge of the first deflecting plate and the inner lateral edge of the second deflecting plate abut each other to form abutting lateral edges and the outer lateral edges of the first and second deflecting plates are flush; (c) positioning a backing strip along and covering the abutting lateral edges of the first deflecting plate and second deflecting plate; (d) positioning a releasable clamp assembly over the outer lateral edges of the deflecting plates and spanning the spanning the abutting lateral edges of the first and second deflecting plates, wherein the releasable clamp assembly comprises;

a first plate holder having a channel receiving the outer lateral edge of the first deflecting plate;

a second plate holder having a channel receiving the outer lateral edge of the second deflecting plate; and a bridge connecting the first plate holder and the second plate holder and comprising one or more releasable clamp adapted to apply a clamping force in a direction perpendicular to the first plate holder channel and second plate holder channel; and (d) engaging the clamp assembly to apply a clamping force to the backing strip, thereby holding the backing strip in secure engagement with the abutting lateral edges of the first and second deflecting plates, and holding the deflecting plates in rigid connection with one another to form a continuously bullet resistant joint.

Figure 1A:
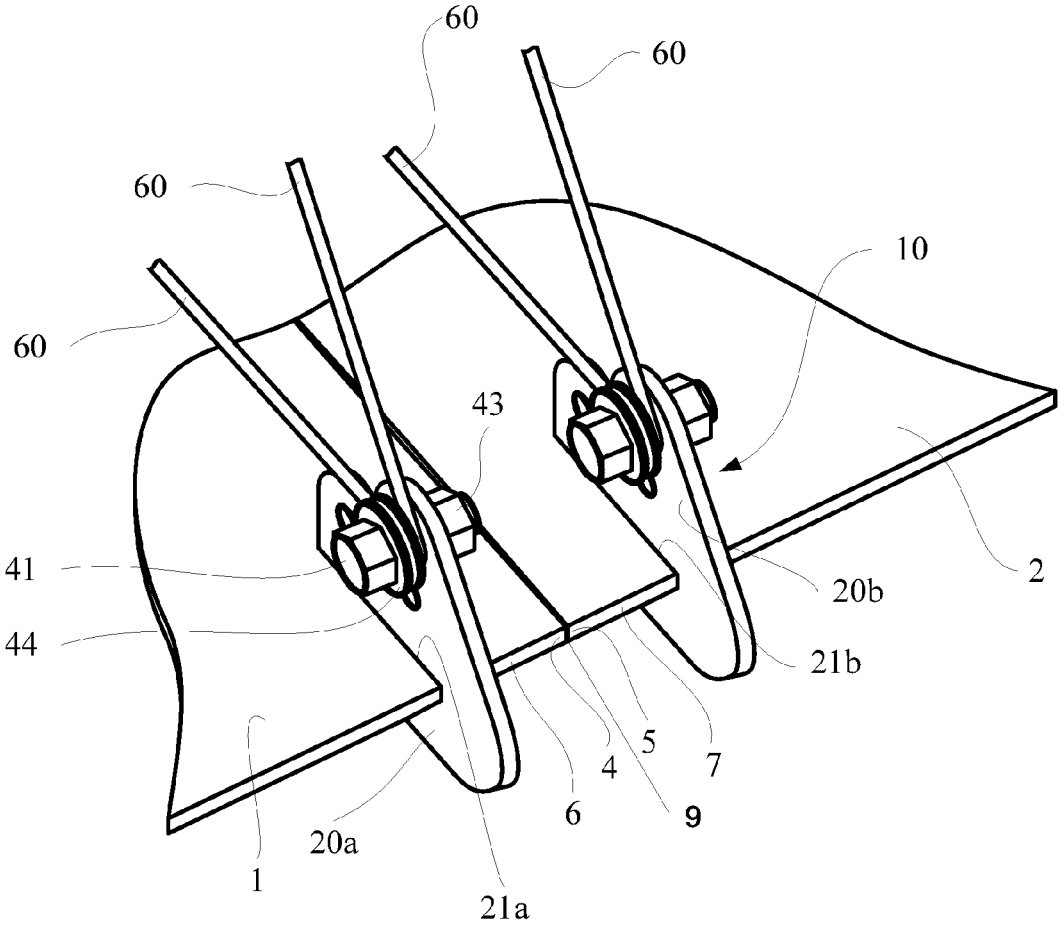
FIG. 1A shows a perspective view of an embodiment of a releasable clamp assembly holding two deflecting plates together at the bottom of the two plates (shown without a clamp assembly or a backing strip in order to show the abutting edges of the plates)

With reference to FIGS. 1 and 1A, one embodiment of a modular bullet deflecting baffle system is shown in a perspective view. FIG. 1 shows a releasable clamp assembly holding two deflecting plates together at the top of the two plates. FIG. 1A is a view of the same embodiment shown in FIG. 1, but showing the releasable clamp assembly holding two deflecting plates together at the bottom of the two plates. FIG. 1A shows an embodiment without a clamp assembly or a backing strip, solely for purposes of illustrating the features of the abutting edges of the plates that would otherwise be hidden from view by the bridge and the backing strip as shown in FIG. 1.

The system shown in FIGS. 1 and 1A is designed to connect a first deflecting plate 1 and a second deflecting plate 2. It is understood that the deflecting plates 1 and 2 are constructed of a material, including any conventional hardened metal or other material, such as iron or steel, or ceramic material, that is bullet resistant or bullet proof and is capable of deflecting bullets. The deflecting plates may be constructed of any shape or dimension suitable for fitting within a defined space. As shown in FIG. 1A, the first deflecting plate has an inner lateral edge 4 abutting an inner lateral edge 5 of the second deflecting plate, to form abutting lateral edges. The first deflecting plate also has an outer lateral edge 6 generally flush with (or coplanar with) an outer lateral edge 7 of the second deflecting plate. The flush outer lateral edges 6, 7 receive a releasable clamp assembly, generally indicated at 10. The releasable clamp assembly 10, in some embodiments, spans the abutting lateral edges 4 and 5. It is understood that the releasable clamp assembly 10 may also be disposed at or near the terminal end of a terminal deflecting plate where there is no abutting lateral edge of a second deflecting plate (i.e., at or near an outer corner of or in the middle of a deflecting plate). Also shown in FIG. 1 is a backing strip 3 disposed along and covering the abutting lateral edges 4 and 5 of the deflecting plates 1 and 2. The backing strip 3 is so named as it would typically be disposed on the backside of the deflecting plates 1 and 2 relative to how the plates would be used by a shooter using the baffle or other bullet deflecting device formed thereby. In other words, the backing strip 3 will generally be on the opposite side of the deflecting plates 1 and 2 from a shooter.

The backing strip 3 is positioned along the seam 9 formed by the abutting lateral edges 4, 5 of the deflecting plates. Because the backing strip 3 does not take the initial hit from a projectile, the backing strip can be made of conventional or other suitable and low cost metal, such as soft steel or iron, to reduce cost. In the alternative, the backing strip 3 may be made from hardened steel or any other hard bullet resistant material to provide additional protection against a bullet or other projectile passing through the seam 9 between the deflecting plates 1, 2.

The backing strip 3 may be, for example, about 45 mm to 55 mm wide, 5 mm to 15 mm thick and has a length approximately the height of the standard deflecting plate to be joined (often, but not always 4 feet long). It is understood that the backing strip 3 need only be sufficiently wide to cover the abutting lateral edges of the deflecting plates, and need only be sufficiently thick to deflect a bullet or bullet fragment and prevent it from passing beyond the deflecting plate with sufficient inertia to cause any harm. As will be appreciated, the length of the deflecting plates will depend on the particular environment in which the modular bullet deflecting baffle system of the present invention is installed. For example, when the deflecting plates will be used to form a suspended baffle for an enclosed shooting range, each plate may be about twenty feet long. For other applications, the length may be shorter or longer. In many cases, deflecting plates of about 8 feet by 4 feet in width are desirable both because that is a common size and because the smaller plates can be handled more easily.

The clamp assembly of the present invention enables use of a backing strip without any modifications, such as drilling holes, welding additional features, such as clamps or fasteners, etc., formed in the backing strip of the deflecting plates.

The backing strip 3 may be disposed on either side of the fabrication intended to be fired upon. FIG. 1 shows an embodiment in which the backing strip is disposed on the opposite side of the fabrication that is being fired upon, which has the advantage of the clamp assembly being mostly on the backside of the firing surface and protected from bullets or bullet fragments that could cause damage of the clamp assembly. The strip can be fabricated from either relatively soft materials or manufactured from hardened materials with the desired configuration. Soft materials can be effectively used because the thickness of the material can be adjusted to insure the desired bullet resistance. The use of manufactured hardened materials for backing strips does not add significantly to the cost of a construct or the cost of transport because they are a minor fabrication element in terms of overall material size and cost. Adjacent deflecting plates are "generally abutting" when the plates are either touching, or nearly touching, or the plates are sufficiently close that the gap between plates is more narrow than the backing strip placed over the gap. In some embodiments, the gap is sufficient to restrict the possible passing of a bullet between the plates. The backing strip can be constructed of material that is the same thickness or greater thickness as the plates, further limiting the possibility that a bullet could pass through. Thickening the backing strips has little impact on the total cost of fabrication.

FIGS. 1 and 1A show that the first deflecting plate 1 has an outer lateral edge 6 and the second deflecting plate 2 has an outer lateral edge 7. (When used in a horizontal array, the outer lateral edges will typically be the top and bottom edges as the side edges abut one another). The outer lateral edges 6 and 7 of the first and second deflecting plates 1 and 2 may be generally flush, or, in other words, are generally level with one another or coplanar. The outer lateral edges need only be aligned to be substantially collinear, or sufficient to enable the releasable clamp assembly 10 to be placed over and be received by both of the outer lateral edges 6 and 7 of the deflecting plates 1 and 2. Thus, the outer lateral edges 6 and 7 of the first and second deflecting plates may be slightly noncollinear, as long as the clamping assembly is able to be placed over the outer lateral edges and effectively clamp down on both deflecting plates, or the clamp assembly may be configured to accommodate for outer lateral edges which are not flush, such as by a longer channel in the plate holder or a shaped plate holder which allows for the uneven outer edges.

Further shown in FIG. 1 is the releasable clamp assembly 10 spanning the abutting lateral edges 4 and 5 of the first and second deflecting plates 1 and 2. The releasable clamp assembly 10 may include a first plate holder 20*a* having a channel 21*a* for receiving the outer lateral edge 6 and a portion of the first deflecting plate 1. A second plate holder 20*b* is also shown having a channel 21*b* for receiving the outer lateral edge 7 and a portion of the second deflecting plate 2. The releasable clamp assembly 10 is disposed over the outer lateral edges 6 and 7 of the deflecting plates 1 and 2, and clamped down, so as to hold the two separate deflecting plates adjacent to one another when clamped.

Figure 2:
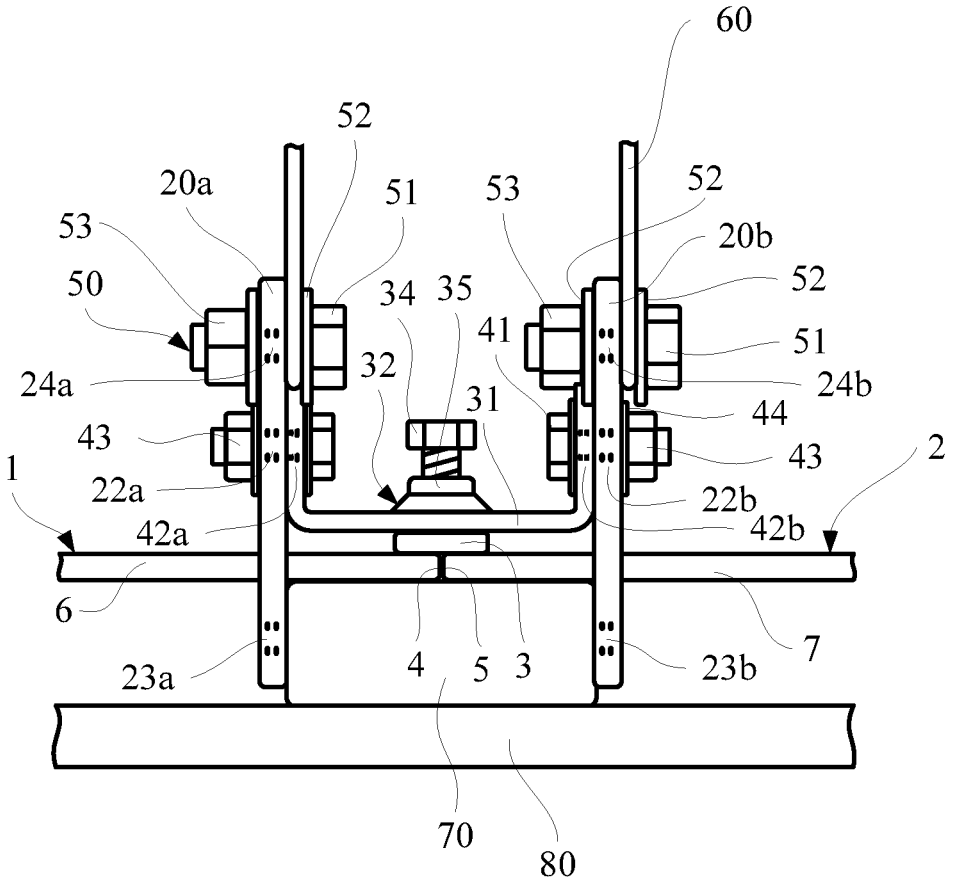
FIG. 2 shows an end view of an embodiment of a releasable clamp assembly holding two deflecting plates together, and also showing a frame and facia attached to the clamp assembly.

As described herein, the channels 21*a*, 21*b* in the plate holders 20*a*, 20*b* are each intended to receive a deflecting plate, and each channel is said to define a plane, meaning the channel creates a space defining a plane within which the deflecting plate is received when inserted into the channel. In some embodiments of the invention, such as shown in FIGS. 1, 1A, and 2, the first plate holder channel and second plate holder channel define planes that are coplanar for receiving the first and second deflecting plates that are coplanar. In other embodiments of the invention, the plane defined by the first plate holder channel for receiving a first deflecting plate and the plane defined by the second plate holder channel for receiving the second deflecting plate may be transverse. The term transverse, when used to compare the planes of two deflecting plates, or the planes of two plate holder channels, means that the two deflecting plates (and the two plate holder channels) are not in the same plane, and instead define planes that are at an angle to each other (i.e., they may be non-coplanar, for example, perpendicular or at a 45 degree angle). For example, the deflecting plates 1 and 2 may be angled about an axis defined by the abutting lateral edges of the deflecting plates, requiring that the plate holders and/or the channels be configured or adapted so that the plane of the channel accommodates deflecting plates that are at an angle.

The channels 21*a* and 21*b* are designed to slip over and receive the outer lateral edges 6 and 7 (typically the tops and bottoms in a horizontal array) of the deflecting plates. In the embodiment shown in FIGS. 1 and 1A, the first plate holder channel 21*a* and the second plate holder channel 21*b* define a coplanar channel for receiving the first and second deflecting plates 1 and 2, which are also substantially coplanar. The depth of the channels may vary, depending on the size and physical dimensions of the clamp assembly. However, the channels 21*a* and 21*b* will have a dimension capable of accommodating the deflecting plates 1 and 2, with a height sufficient to accommodate the thickness of the deflecting plates (i.e., equal to or greater than the thickness of the deflecting plates) and a depth sufficient to receive a portion of the deflecting plate necessary for the clamp assembly to be positioned over the deflecting plates and allow the clamping mechanism to clamp down on the backing strip 3 disposed against the lateral edges 4, 5 of the deflecting plates with sufficient force to hold the backing strip in secure engagement with the abutting lateral edges of the first and second deflecting plates. The clamping action thereby holds the deflecting plates in substantially rigid connection with one another to form a continuously bullet resistant joint. It is understood that the depth of the channels should leave sufficient plate holder material between the inner end of the channels 21*a* and 21*b* and the outer edge of the plate holders 20*a* and 20*b* to support the weight of the deflecting plates. Plate holders may be designed to have sufficient material between the ends of the channels and the outer edge of the plate holders by, for example, having greater distance between the ends of the channels and the outer edge of the plate holders, or by increasing the thickness of the plate holder at that location.

Figure 3:
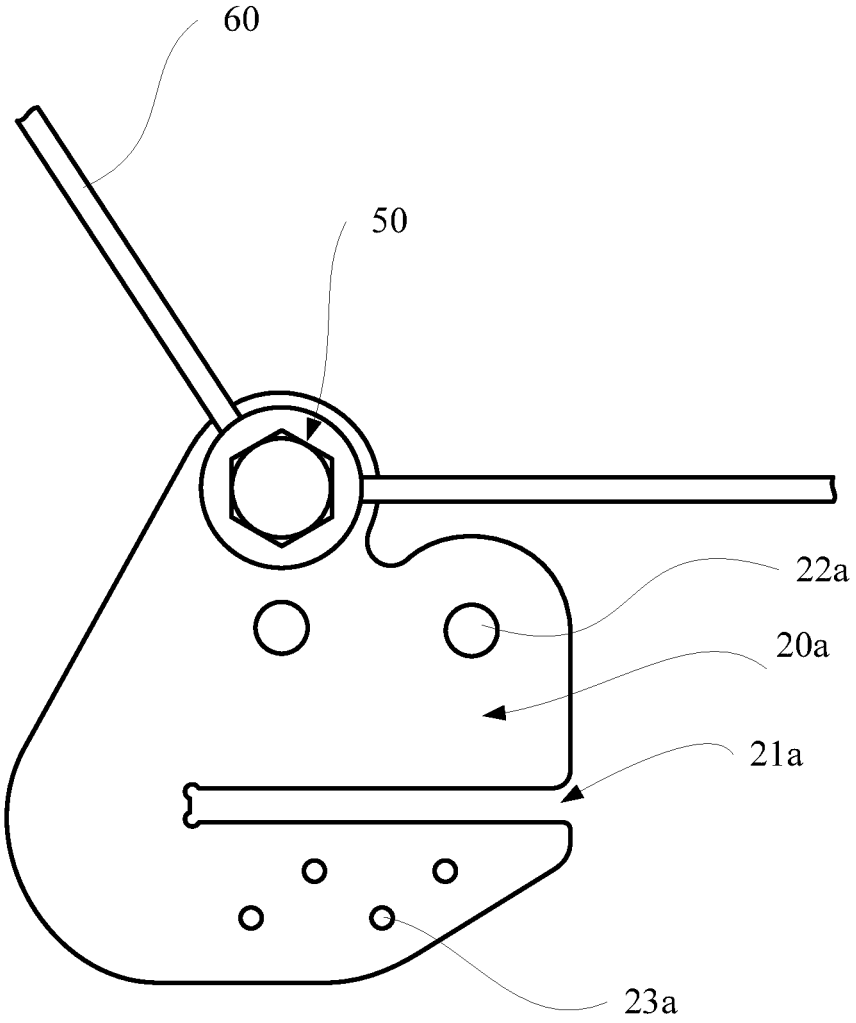
FIG. 3 shows a side view of a plate holder, with a hanging wire and wire harness assembly attached.

Also shown in FIG. 1 is a bridge 30 connecting the first plate holder 20*a* and the second plate holder 20*b*. The bridge 30 comprises a bridge 31, spanning and connecting the plate holders, and a releasable clamp 32 connected to the bridge 31. The bridge is connected to the two plate holders 20*a* and 20*b* by any means ordinarily available and known to those skilled in the art, including, for example, by means of welding, bolting, riveting, etc. In the embodiment shown in FIG. 1, the bridge assembly 30 is comprised of a bridge 31 with each end bent at an approximately 90 degree angle. As shown in FIG. 1, the ends of the bridge 31 may be fastened or secured to the plate holders 20*a* and 20*b* by means of a bolt 41, nut 43, and washers 44. Other fasteners can also be used. FIG. 2 shows a bolt 41 inserted through the hole 22*a* of the plate holder 20*a* and the hole 42*b* in one end of the bridge 31, and a bolt 41 inserted through the hole 22*b* of the plate holder 20*b* and the hole 42*a* of the other end of the bridge 31 (shown in FIG. 2 in end view and FIGS. 3 and 4 without the bolts). The bolts 41 are secured with nuts 43 and washers 44.

Figure 8A:
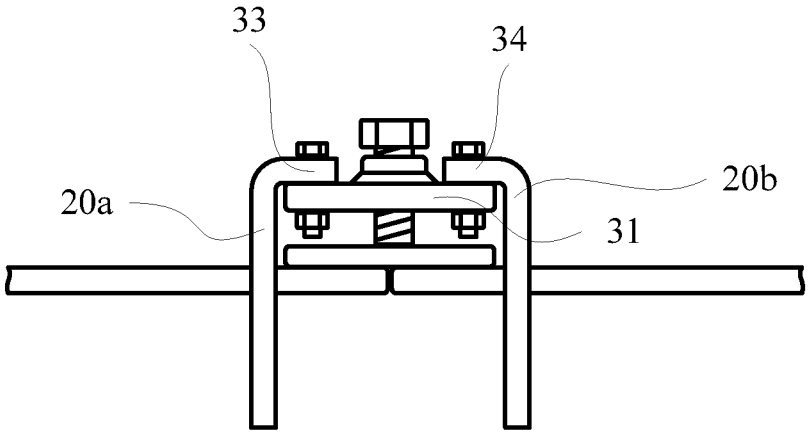
FIG. 8A shows a configuration where the top of the plate holders are bent to create a flange to which the bridge is connected.
Figure 8B:
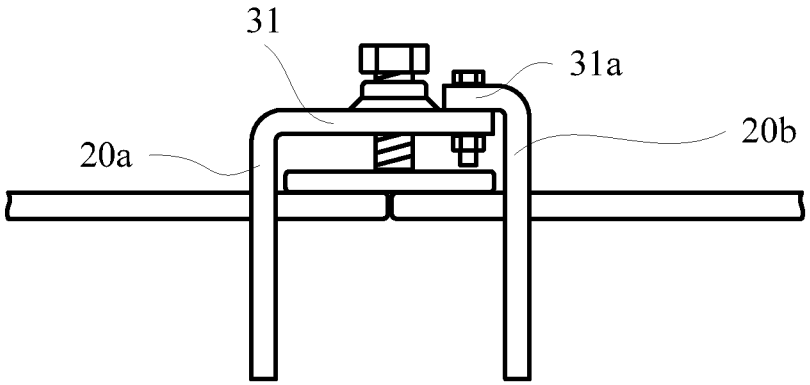
FIG. 8B shows a configuration where the top of the plate holders are bent to create a flange, where the flange on one of the plate holders is sufficiently long that it extends to and overlaps with the flange on the opposite plate holder, and the overlapping flanges are connected with a nut and bolt.
Figure 8C:
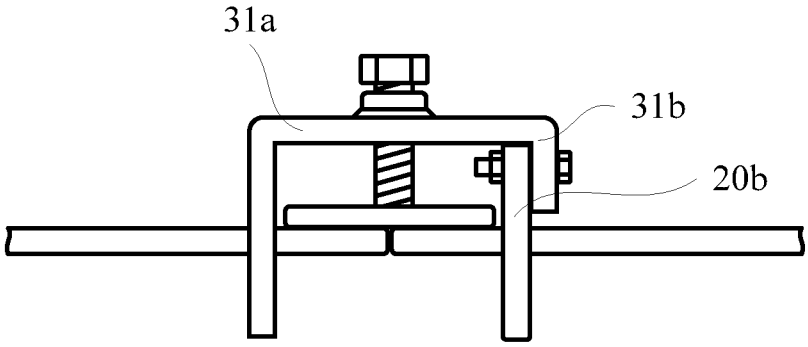
FIG. 8C shows a configuration where the top of one plate holder is bent to create a flange that is sufficiently long that it extends to and overlaps with the opposite plate holder, and the flange and opposite plate holder are connected with a nut and bolt.
Figure 8D:
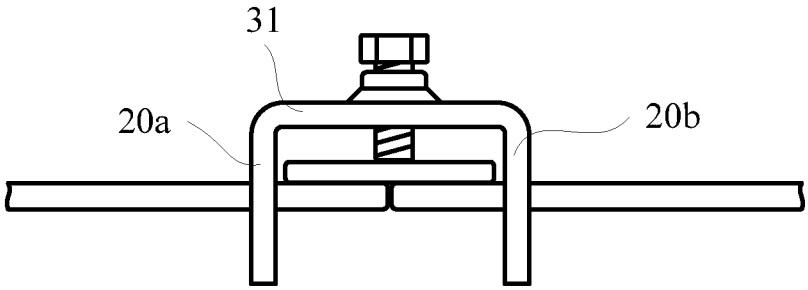
FIG. 8D shows a configuration where the first and second plate holders are made of a single piece of metal that is bent to form parallel plate holders and a bridge spanning the plate holders.

FIGS. 8A-8D show possible configurations of the plate holders joined together with a bridge, for example, where the bridge is integral with one or more of the plate holders. A bridge is considered "integral" with a plate holder when the bridge and plate holder are made from the same stock of material, which is bent to form two different functional surfaces (one with a channel configured to receive the deflecting plate, and another servicing as a bridge to which the clamp is connected). Alternatively, a bridge is "integral" with a plate holder if, for example, the bridge and plate holder are derived from separately cut pieces of material that are subsequently welded together to form a single piece of material. As described in more detail in reference to the drawings, in some configurations the bridge may be integral with one plate holder, and in other configurations the bridge may be integral with both plate holders. For example, FIG. 8A shows a configuration where the top of the plate holders 20*a* and 20*b* are bent to create flanges 33 and 34, to which a bridge 31 is connected. The inwardly bent flanges 33 and 34 provide a structure for the clamp that avoids shear forces on the bolts. FIG. 8B shows a configuration where the bridge is integral with one of the plate holders. In FIG. 8B, the top of the plate holders 20*a* and 20*b* are bent to create flanges, where the flange 31 on one of the plate holders is sufficiently long that it extends to and overlaps with the flange 31*a* on the opposite plate holder, and the overlapping flanges are connected with a nut and bolt. FIG. 8C shows a configuration where the top of one plate holder is bent in multiple locations, to create a horizontal flange 31*a* that is sufficiently long that it extends to and overlaps with the opposite plate holder, where it has an additional downward bend to create a vertical flange that overlaps with the other plate holder 20*b*. The flange of the first plate holder and the opposite plate holder are connected with a nut and bolt. The longer flange 31*a* provides a bridge which serves as a support for a clamp. FIG. 8D shows another configuration where the bridge is integral with both the first and second plate holders 20*a* and 20*b*. The first and second plate holders and the bridge are made of a single piece of material that is bent at two locations, with the two sides forming two parallel plate holders 20*a* and 20*b* and the middle portion forming a bridge 31, which provides support for the clamp.

As shown in the embodiment of FIG. 1, the bridge 30 includes a releasable clamp 32 attached to or integrated with the bridge 30. The releasable clamp is positioned to apply a clamping force in a direction substantially perpendicular to the face of the deflecting plates 1 and 2 and perpendicular to the coplanar channels 21*a* and 21*b* which receive the deflecting plates. It is understood that the force need not be applied in a direction that is exclusively perpendicular, since the force may be at an angle having one component of the force perpendicular to the face of the deflecting plates and one component transverse to the face of the deflecting plates, provided only that the component of force that is in a direction perpendicular to the face is sufficient to hold the backing strip against the deflecting plates and hold the deflecting plates in place. Force is applied directly to the backing strip 3 with the bolt 34 screwed against the backing strip 3, which in turns applies force to the deflecting plates 1 and 2. It is understood that the releasable clamp 32 may apply force directly to any other intermediate structure between the clamp and the backing strip 3, or between the backing strip and the clamp, so long as a clamping force is applied directly or indirectly to the deflecting plates. In the embodiment of FIG. 1, the backing strip is positioned over the abutting lateral edges 4 and 5 of the deflecting plates 1 and 2, which are held securely in the channels 21*a* and 21*b* of the plate holders 20*a* and 20*b* by the downward force of the clamp 32 on the backing strip 3 and on the abutting lateral edges 4 and 5 of the deflecting plates 1 and 2, thereby holding the backing strip in secure engagement with the abutting lateral edges of the deflecting plates, and holding the deflecting plates in rigid connection with one another to form a continuously bullet resistant joint. The releasable clamp applies sufficient force to the backing strip and the abutting lateral edges of the deflecting plates to hold the deflecting plates in rigid connection with one another and to form a continuously bullet resistant joint.

The releasable clamp 32 may be selected from any one of many different types of clamps known and used by those skilled in the art. For example, as shown in FIG. 1, a bolt 34 may be screwed into a nut 35 that is welded to the surface of the bridge over a hole in the bridge of sufficient size to accommodate the shank of the bolt 34. In a different embodiment, the releasable clamp may be comprised of a threaded bolt that is screwed into a corresponding threaded hole in the bridge itself. By screwing the bolt into and through the threaded hole or nut, the shank of the bolt applies pressure to the backing strip and deflecting plates, holding them in position. In another embodiment, the releasable clamp may be a lever that, when engaged, applies force to the backing strip and deflecting plates. Other embodiments of a releasable clamp may be known to those in the art for use in the present invention.

Optionally, the clamping assembly may also include other features, such as holes, threaded or unthreaded, and brackets, which enable the attachment of other functional components to the modular bullet deflecting baffle system. For example, the clamping assembly may comprise components for a wiring harness for use in securing a hanging wire to the plate holder, to allow hanging or suspending of the modular bullet deflecting baffle system from a structure, such as a ceiling or a wall. FIGS. 1, 1A, 2 and 3 illustrate a system having a hanging harness 50 for securing a support wire 60 to the releasable clamp assembly 10. As shown in FIGS. 1A and 2, in one configuration the hanging harness comprises a bolt 41 inserted through holes 24*a* or 24*b*, to which is threaded a nut 53 with a washer 52. The hanging harness may comprise any structure known and used in the art for securing support wire to an object. In one embodiment, the hanging harness may secure support wire or cable in a manner that fixes the wire relative to the wiring harness so that it does not slip. In another embodiment, the hanging harness may attach a support wire in such a manner that allows the wire to slip freely within a hole in the clamping system (i.e., a hole in the plate holder). In another embodiment, the hanging harness may attach a support wire 60 that is strung to another clamp assembly, for example, from a clamp assembly at the top of two deflecting plates (as shown in FIG. 1) down to a clamp assembly at the bottom of two deflecting plates (as shown in FIG. 1A). Because the modular bullet deflecting baffle system of the present invention contemplates that the deflecting plates 1 and 2 are manufactured from bullet resistant materials, such as steel or other high impact resistant materials, the weight of such materials will in some instances require that the support wire be fixed to the hanging harness so that the deflecting plates (and the clamp assembly attached to the plates) do not slip relative to the wire, thereby stabilizing the entire baffle system structure. In such instances, the deflecting plates may be fixed relative to the hanging harness wire using bolts, as shown in FIGS. 1, 1A and 2. In other configurations, the support wire may be simply threaded from a support structure, such as a ceiling, through holes in one or more plate holders, or through multiple clamp assemblies, and then back to the structure.

In some embodiments, the hanging harness may comprise a wire bolt fastened to the plate holder, with the hanging wire or chain disposed through the wire bolt, as a means of suspending the system from a structure, such as a wall or ceiling. Typically, a chain or steel cable is attached through holes in the plate holders, and the chain or steel cable is then attached to a support structure, such as a wall or ceiling. One or more attachment points per joint may be used to suspend a given fabrication. Similar attachment points may be connected using similar means for supporting a deflecting plate at the terminal edge of each terminal plate.

FIG. 1 shows a particular embodiment having a wire bolt 51, comprising a bolt head, and a bolt shank having a hole (not shown) disposed through the bolt shank near the bolt head, through which a support wire 60 is threaded or passed. A support wire is then connected to the wire bolt, for example, it may be disposed or threaded through a hole in the wire bolt. Wire bolts may be of any one of many different configurations known to those skilled in the art. For example, the wire bolt may be a bolt with a sufficiently wide head that the support wire can be wrapped around the shank and fixed in place by simply tightening a nut on the bolt. Alternatively, the wire bolt may be a bolt having a hole through the shank near the head of the bolt for receiving a hanging wire. A wire is inserted through the hole in the bolt shank, the bolt is inserted into a hole in the plate holder, and a nut used to tighten the bolt, causing the wire through the hole of the bolt shank to be clamped between the inside of the bolt head and a face of the plate holder. In other embodiments, a wire bolt may comprise a bolt with a shank extending from two opposite sides of the bolt head, with one shank for securing to the plate holder, and the other shank comprising a split shank into which a wire may be inserted in the split portion, followed by a bolt over the split shank, which bolt, upon tightening, clamps the wire against the head and fixes the wire relative to the clamp assembly. In other embodiments, the wire bolt may comprise a U-bolt having threaded shanks on each end of a U-shaped bolt. Wire is then threaded through the U portion of the bolt, inserting the shanks of the U-bolt into two holes in the plate holder, and tightening nuts on the shanks to clamp the wire between the U-bolt and the face of the plate holder, thereby fixing the wire relative to the clamp assembly. Other types of fasteners known to those of ordinary skill in the art may also be used to fix the wire the clamp assembly.

The clamp assembly of the present invention may also be utilized to support other structures, such as a frame and fascia, which may be used to simulate a real-world environment, such as a room with ordinary walls comprised of painted or wall-papered dry wall. Referring to FIG. 2, there is shown an end view of an embodiment of the invention, comprising a frame 70 attached to the plate holder. FIG. 2 further illustrates the use of a frame 70 attached to the plate holders 20*a* and 20*b* with a fastener (not shown) inserted through holes 23*a* and 23*b*, with fascia 80 attached to the frame 70. Typically, the frame 70 will be made of two by four studs, which extend the length of the backing strip 3, and are attached to the plate holders by means of any known fastener, such as a screw or nail inserted through holes 23*a* and/or 23*b* in plate holders 20*a* and/or 20*b*. The fascia 80 may be comprised of such materials as acoustic tile, sheetrock (dry wall), plywood, or other conventional building material, or other types of sheathing, such as rubber, self healing rubber and the like.

The fascia 80 may be attached to the clamp assembly either directly or indirectly. For example, the fascia 80 may be attached directly to the clamp assembly by fasteners, such as screws or nails, inserted through the holes 23*a* and/or 23*b* in the plate holder 20*a* and/or 20*b*, directly into the fascia. Alternatively, the fascia 80 may be attached to the clamp assembly by means of a bracket that is similarly fastened to the plate holder 20*a* and/or 20*b* by means of a bolt or welding, and the fascia 80 attached to the bracket with a fastener, such as a bolt, screw or nail through the holes 22*a* and/or 22*b*. Alternatively, as shown in FIG. 2, the fascia 80 may be attached to the clamp assembly via a frame 70 comprised of studs (e.g. either conventional wood 2×2 or 2×4 studs or metal studs). It will be appreciated that the studs forming the frame 70 could also extend from backing strip to backing strip in a transverse manner. This method of fabrication simulates conventional building construction and allows the attachment of realistic walls, ceilings, doors, and the like, to the bullet deflecting plates, thereby allowing versatility of environmental simulation.

Figure 4:
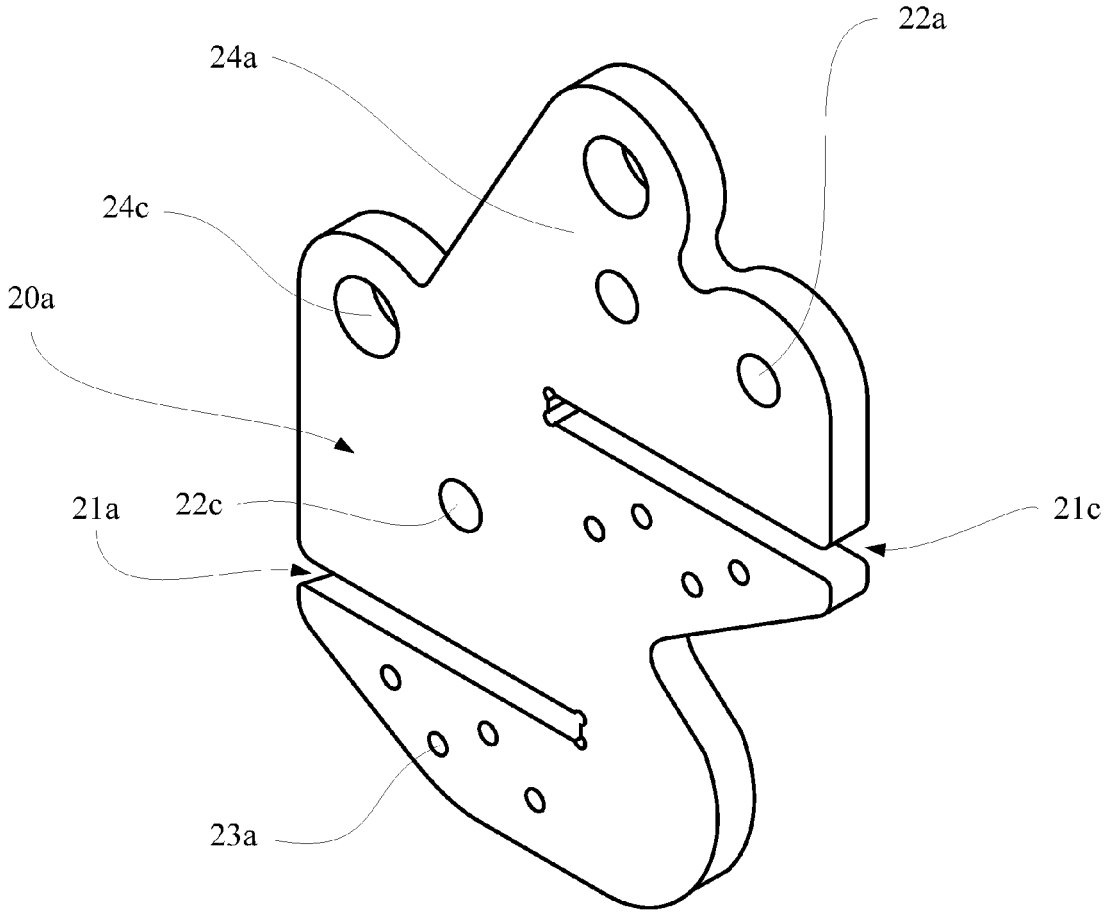
FIG. 4 shows a perspective view of a plate holder having two channels extending in from opposing sides of the plate holder in a generally parallel configuration and FIG. 4A shows the channels in an non-parallel configuration.

In some embodiments, as shown in FIG. 4, each plate holder may comprise a second channel for receiving one or more additional deflecting plates. FIG. 4 shows a plate holder 20*a* with multiple channels 21*a* and 21*c* configured to receive multiple deflecting plates. In some embodiments, the second channels of the first and second plate holders define a coplanar channel configured to receive the third and fourth deflecting plate. In other embodiments, such as shown in FIG. 4, the first and second channels of the plate holder are not coplanar, but are in generally parallel planes. Alternatively, the first and second channels of the plate holder may be at a different angle, defining non-parallel planes. As shown in the embodiment of FIG. 4, the second channel 21*c* may, for example, be located on the opposite side of the plate holder as the first and channels 21*a*, in a parallel plane slightly above the second channel, or alternatively in a non-parallel plane.

FIG. 4 also shows that the second channel 21*c* may overlap with the first channel, so as to allow the deflecting plates in the first and second channels to overlap and prevent penetration of a bullet through a gap between adjacent deflecting plates. Thus, for example, an upper array of plates may be disposed at an angle relative to a shooter with the plate holder 20*a* positioned at the bottom of an upper plate received in channel 21*a*. A lower plate may be positioned so that the upper outer lateral edge of one deflecting plate is positioned in channel 21*c* and extends beyond the lower outer lateral edge 6 of another plate. This leaves an overlap of the two plates which extends upwardly and toward the shooter. When the plates are impacted by a projectile, the projectile will tend to deflect downwardly and away from the shooter, thereby not passing through the small space between the offset plates.

In a system where a plate holder has more than one channel, the releasable clamp assembly may further comprise a second bridge connecting the first plate holder and the second plate holder, and a second releasable clamp, wherein the second releasable clamp clamps to the third and fourth deflecting plates.

Figure 5:
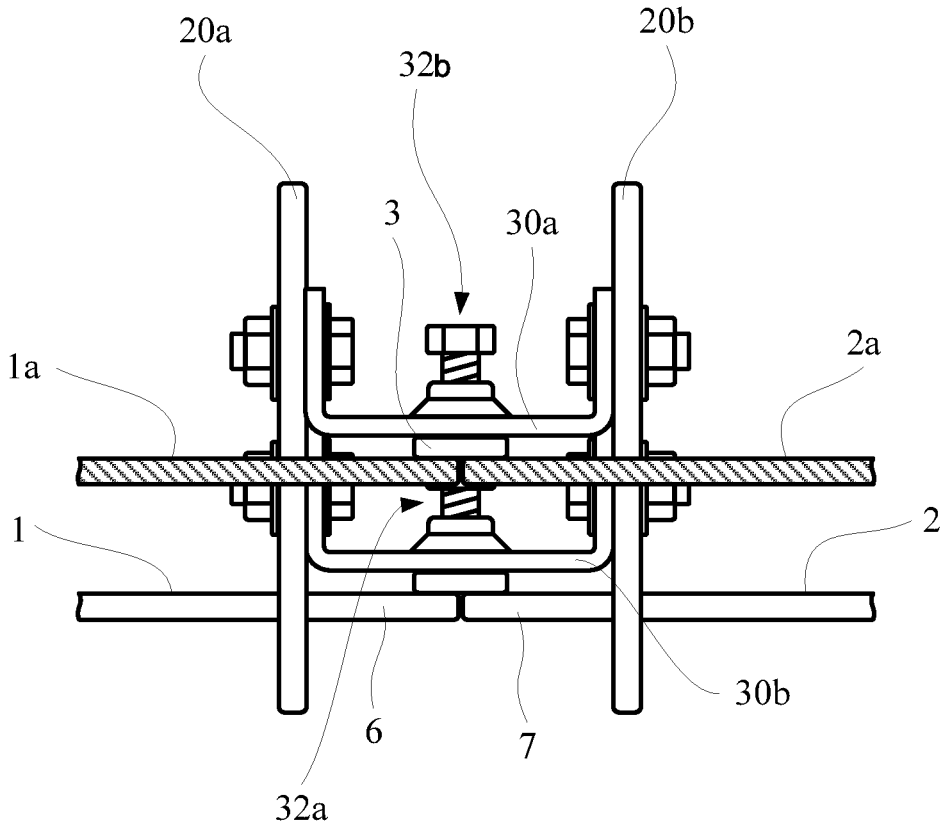
FIG. 5 shows an end view of a first array of deflecting plates and a cross-sectional view of a second array of deflecting plates so as to show the two bridges as they may be used with the plate holder of FIG. 4.

FIG. 5 provides an end view of a system using a double channel plate holder shown in FIG. 4, with the plate holders 20*a* and 20*b* each having two channels, one channel configured to receive deflecting plates 1 and 2, and the second channel configured to receive deflecting plates 1*a* and 2*a* (shown with hatched lines). The two plate holders 20*a* and 20*b* are connected together with a first bridge 30*a* and a second bridge 30*b*, each of which are configured with a clamp 32*a* and 32*b*.

It is understood that in a system where the plate holders have more than one channel, it will be necessary to have sufficient plate holder material between the various channels that the weight bearing capacity of the plate holder is not adversely affected for purposes of supporting the weight of the deflecting plates. This may be accomplished by either assuring there is sufficient space between the channel and the side of the plate holder, or between the channel and the second channel on the opposite side of the plate holder. Alternatively, this may be accomplished by increasing the thickness of the plate holders to give added strength to the plate holder.

Figure 4A:
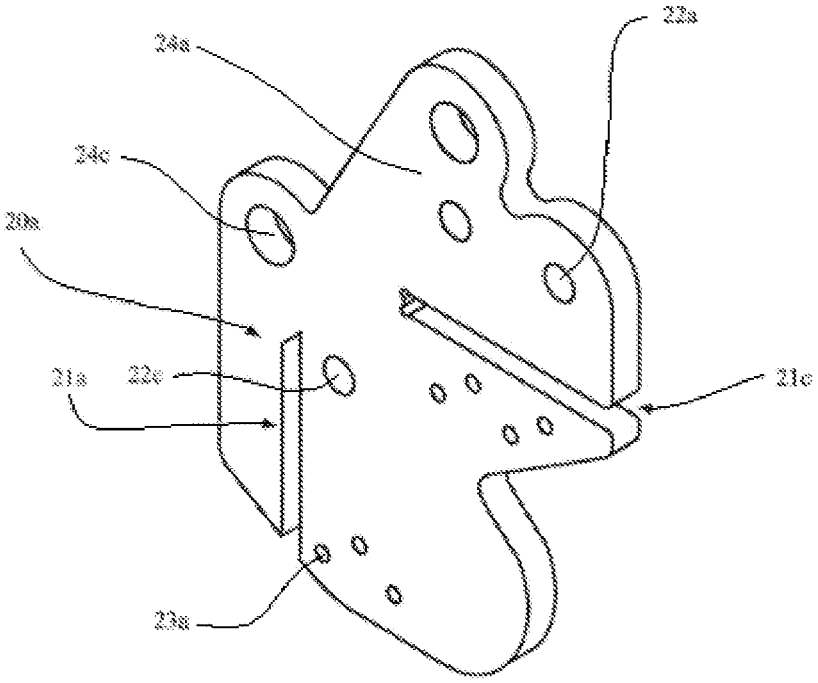

In embodiments where the deflecting plates and are at different angles (i.e., not in the same or parallel planes), a second channel may be provided in each plate holder, with a second bridge and a second releasable clamp. In one embodiment, the plate holder of FIG. 4 may be used to support a releasable clamp assembly that is disposed over the outer lateral edges of a first and second deflecting plate, spanning the abutting lateral edges of the third deflecting plate and the fourth deflecting plates. As shown in FIG. 4, the plate holder 20*a* has channels 21*a* and 21*c* that receive the outer lateral edges of separate deflecting plates. It is understood that the plate holder 20*a* of FIG. 4 would be used in conjunction with a second similar plate holder, which plate holders would be connected with one or more bridges associated with each of the channels 21*a* and 21*c*, each having their own clamp assembly for applying force to the underlying deflecting plate and holding it in secure engagement relative to the adjacent deflecting plates. A configuration used with non-parallel plates is shown in FIG. 4A.

The second bridge may be substantially identical to the bridge previously discussed and may function in the same way. Thus, the second bridge is not expressly shown but will be understood to be usable with the invention. Thus, for example, hole 22*c* in the holding plate shown in FIG. 4 could be used to receive a bridge just as hole 22*a* is shown in FIG. 2. Likewise, hole 24*c* could receive a bolt to hold a support wire just as hole 24*a* is shown receiving a bolt in FIG. 2. FIG. 5 shows and end view of one set of deflecting plates 1, 2 and a cross-sectional view of a second set of deflecting plates 1*a*, 2*a* engaging a plate holder 20*a* as shown in FIG. 4, along with two bridges 30 and backing strips 3. It will be appreciated that the support wires 60 may also be used in a manner similar to FIG. 2 and could include either a single pair of wires or a pair for each set of deflector plates. The wires and bolts have been omitted for clarity.

In another embodiment, the modular bullet deflecting baffle system of the invention may utilize a clamping assembly that accommodates two deflecting plates disposed at an angle to each other, wherein the first plate holder and second plate holder are angled with respect to each other. An angled backing strip may be disposed along and cover the abutting lateral edges of the deflecting plates. In such an embodiment, the releasable clamp assembly may comprise a single bridge having two separate clamps, one for each deflecting plate, at an angle to one another.

The modular bullet deflecting baffle system may also comprise fascia covering the bullet deflecting plates 1 and 2 for either cosmetic purposes (i.e. to simulate ordinary household walls), or for the purpose of capturing bullets that penetrate the fascia, deflect against the deflecting plates, and drop through the space between the fascia and the deflecting plates and into a container for recycling of bullets. Thus, in one embodiment, the present invention may comprise fascia secured to the deflecting plates by means of being secured to the plate holder with fasteners inserted through the plate holder holes and into the fascia. FIG. 2, for example, shows a plate holder 20*a*, having holes 23*a* and 23*b* for securing a frame 70 to the plate holder with a fastener (not shown), to which fascia 80 is secured. Alternatively, the fascia 80 may be secured to the plate holder 20*a* or 20*b* directly, such as by means of fasteners inserted into the fascia through the holes of the plate holders.

Figure 6:
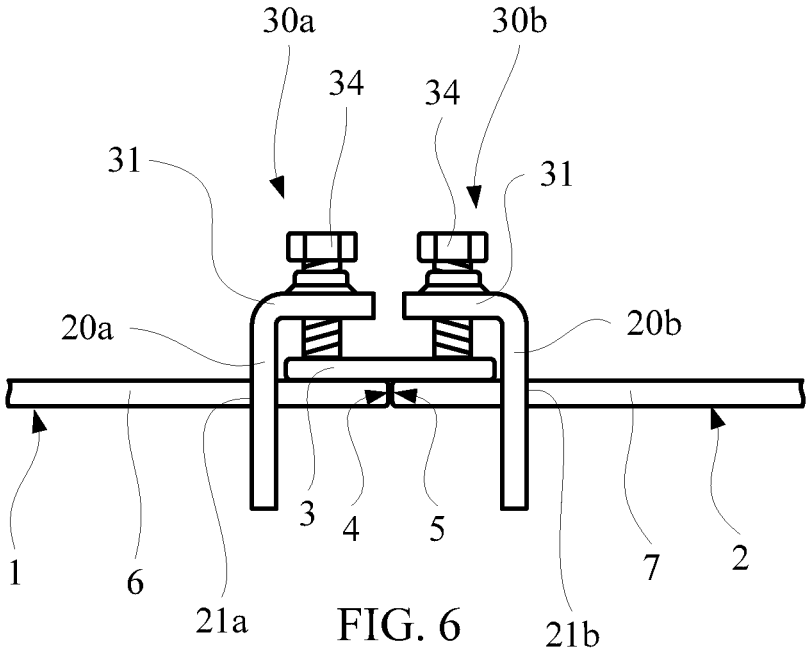
FIG. 6 shows an end view of a possible embodiment without a bridge.
Figure 6A:
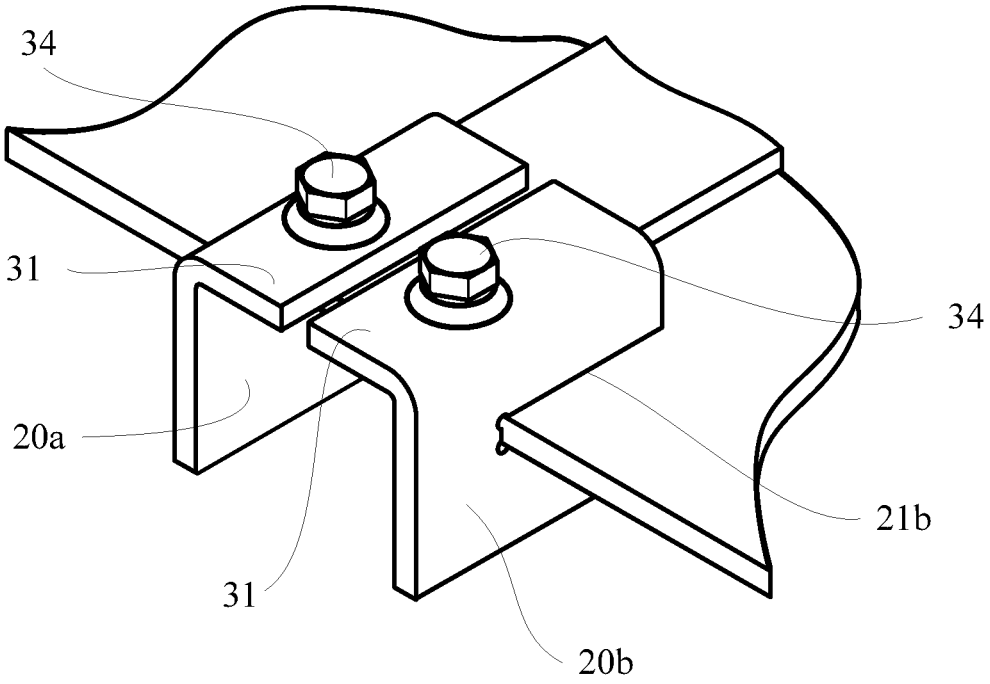
FIG. 6A shows a perspective view of the embodiment of FIG. 6.

FIGS. 6 and 6A show an embodiment in which two plate holders are used in combination to secure together two deflecting plates 1 and 2. In this embodiment, the two plate holders 20*a* and 20*b* have a top portion that is bent to form a flange, and channels 21*a* and 21*b* into which the deflecting plates 1 and 2 are inserted. The top portion of the plates holders that are bent to form a flange are used as a base for the screw clamps 34, which are screwed against a backing strip 3 to secure deflecting plates 1 and 2 together.

Figure 7:
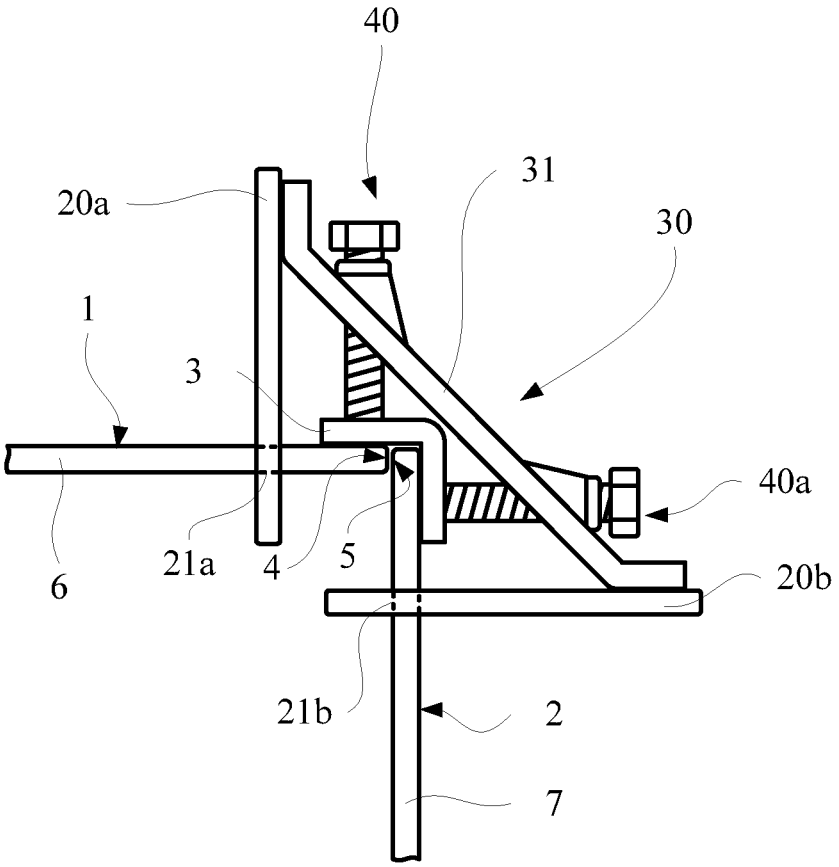
FIG. 7 shows an end view of an embodiment in which the deflecting plates are at an angle to one another, with appropriate modifications to the clamping assembly to accommodate the angled deflecting plates.
Figure 7A:
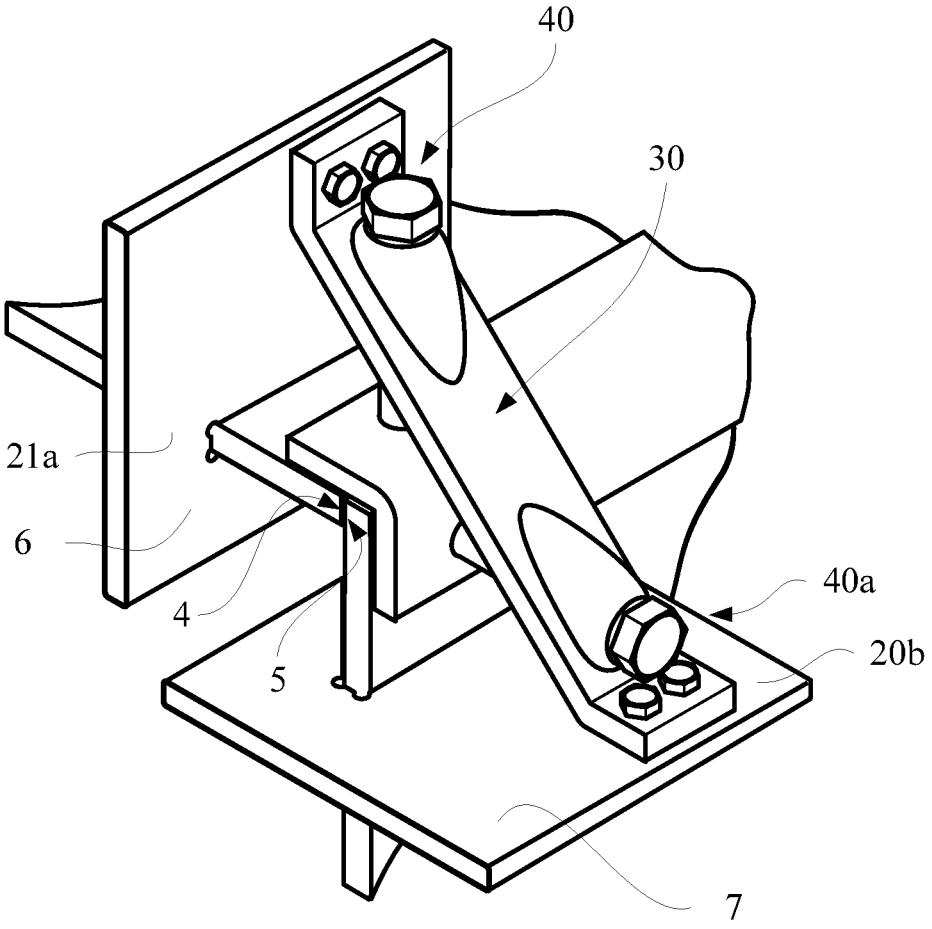
FIG. 7A is a perspective view of the embodiment of FIG. 7.

The present invention further contemplates embodiments in which the clamp assembly may be modified to accommodate deflecting plates that are not coplanar (i.e., simulating a corner of a room or the corner of a wall and ceiling). For example, in one configuration shown in FIGS. 7 and 7A, the clamp assembly may be modified such that the plate holders are angled to accommodate any particular angles of the deflecting plates desired. Two adjacent plate holders 20*a* and 20*b* are positioned at an angle (for example, perpendicular) to one another, and the channels 21*a* and 21*b* are placed over the outer edges 6 and 7 of the deflecting plates 1 and 2, respectively. A bridge 31 spans the two angled plate holders. The bridge 31 is configured to connect the two angled plate holders, for example, by having a bend in the bridge, and a nut and bolt assembly securing the bridge to the plate holders. Alternatively, the top portion of the plate holders may be bent at a selected angle to achieve the desired angle of the plate holders. Where the clamping assembly needs to clamp down on deflecting plates having surfaces that are not in the same plane, the bridge may include a plurality of releasable clamps, one for each deflecting plate, on a single bridge. Alternatively, the clamping assembly may have a plurality of bridge assemblies each with one or more clamps. A backing strip 3 may be bent along the axis defined by the abutting lateral edges of the deflecting plates, using one or more releasable clamps to apply force to the backing strip at the bend or at separate points on each surface on both sides of the bend.

Similarly, the present invention contemplates embodiments in which the coplanar channels of the first and second plate holders are at a different angle than the coplanar second channels. For example, each plate holder may include a second channel that is at an oblique or transverse angle (i.e., not parallel) to the first channel.

The present invention further contemplates methods for constructing a modular bullet deflecting device. For example, in one embodiment, the method comprises first positioning a first deflecting plate adjacent a second deflecting plate, the first deflecting plate having a lateral edge abutting a lateral edge of the second deflecting plate and forming a flush outer lateral edge for receiving a releasable clamp assembly. The releasable clamp assembly comprises a first plate holder having a channel for receiving the outer lateral edge of the first deflecting plate, a second plate holder having a channel for receiving the outer lateral edge of the second deflecting plate, and a bridge connecting the first plate holder and the second plate holder and comprising a releasable clamp. After the deflecting plates are positioned adjacent to each other, a backing strip is positioned along and covering the abutting lateral edges of the first deflecting plate and second deflecting plate. The releasable clamp assembly is then positioned over the outer lateral edges of the deflecting plates, spanning the abutting lateral edges of the first and second deflecting plates, the first plate holder channel receiving the outer lateral edge of the first deflecting plate and the second plate holder channel receiving the outer lateral edge of the second deflecting plate. Finally, a clamping force is applied to the backing strip, thereby holding the backing strip in secure engagement with the abutting lateral edges of the first and second deflecting plates, and holding the deflecting plates in rigid connection with one another to form a continuously bullet resistant joint.

Those skilled in the art will recognize various modifications which could be made to the embodiments disclosed herein without departing from the scope and spirit of the invention. The following claims are intended to cover such modifications.

The invention claimed is:

1. A modular bullet deflecting baffle system, the system, when assembled, comprising:

a first deflecting plate having an inner lateral edge, and a second deflecting plate having an inner lateral edge, wherein the first deflecting plate and second deflecting plate are positioned such that the inner lateral edge of the first deflecting plate and the inner lateral edge of the second deflecting plate substantially abut each other to form abutting lateral edges;

a backing strip disposed along and covering the abutting lateral edges of the first deflecting plate and second deflecting plate;

a releasable clamp assembly comprising:

a first plate holder having a channel for receiving the outer lateral edge of the first deflecting plate;

a second plate holder having a channel for receiving the outer lateral edge of the second deflecting plate; and a bridge connecting the first plate holder and the second plate holder and comprising one or more releasable clamp positioned to apply a clamping force in a direction generally perpendicular to the first plate holder channel and second plate holder channel.

2. The system of claim 1, wherein the channel of the first plate holder and channel of the second plate holder are coplanar.

3. The system of claim 1, wherein one or more of the first and second plate holder comprises a hanging harness for securing a hanging wire to the plate holder.

4. The system of claim 1, wherein the hanging harness comprises a wire bolt fastened to the plate holder.

5. The system of claim 4, further comprising hanging wire disposed through the wire bolt.

6. The system of claim 1, wherein one or more of the first and second plate holder comprises one or more holes for securing fascia to the plate holder.

7. The system of claim 1, further comprising a frame secured to a plate holder.

8. The system of claim 7, further comprising fascia secured to the plate holder.

9. The system of claim 1, wherein the releasable clamp comprises a threaded hole through the bridge assembly and a threaded bolt disposed within the threaded hole, wherein screwing the bolt through the hole results in the bolt applying force to the backing strip and to the deflecting plates.

10. A system for holding deflecting plates adjacent to one another, the system comprising:

a releasable clamp assembly for supporting one or more bullet deflecting plates, comprising:

a first plate holder having a channel for receiving an outer lateral edge of a first deflecting plate;

a second plate holder having a channel for receiving an outer lateral edge of a second deflecting plate; and a bridge comprising a bridge connecting the first plate holder and the second plate holder and at least one releasable clamp, wherein the at least one releasable clamp is adapted to apply a clamping force in a direction perpendicular to the first plate holder channel and second plate holder channel; and a backing strip;

wherein the releasable clamp comprises a threaded hole through the bridge assembly and a threaded bolt disposed within the threaded hole, wherein screwing the bolt through the hole results in the bolt applying force to the backing strip; and wherein the first plate holder further comprises a second channel for receiving the outer edge of a third deflecting plate, and the second plate holder comprises a second channel for receiving the outer lateral edge of a fourth deflecting plate.

11. The system for holding deflecting plates adjacent to one another of claim 10, wherein the channel of the first plate holder and the channel of the second plate holder are coplanar when the first plate holder and the second plate holder are attached to the bridge.

12. The system for holding deflecting plates adjacent to one another of claim 10, wherein one or more of the first plate holder and second plate holder comprises a hanging harness for securing a hanging wire to the plate holder.

13. The system for holding deflecting plates adjacent to one another of claim 12, wherein the hanging harness comprises a wire bolt fastened to the plate holder.

14. The system for holding deflecting plates adjacent to one another of claim 13, further comprising hanging wire disposed through the wire bolt.

15. The system for holding deflecting plates adjacent to one another of claim 10, wherein one or more of the first and second plate holder comprises one or more holes for securing fascia to the plate holder.

16. The system for holding deflecting plates adjacent to one another of claim 15, further comprising fascia secured to the plate holder.

17. The system for holding deflecting plates adjacent to one another of claim 10, further comprising a second bridge assembly connecting the first plate holder and the second plate holder, and a second releasable clamp positioned on the second bridge to apply a clamping force in a direction generally perpendicular to the second channel.

18. The system for holding deflecting plates adjacent to one another of claim 10, wherein the second channel of the first plate holder and the second channel of the second plate holder are coplanar when at least one bridge assembly is attached to the first plate holder and the second plate holder.

19. The system for holding deflecting plates adjacent to one another claim 10, wherein the first and second channels of the first plate holder overlap the first and second channels of the second plate holder in a plane bisecting the first plate holder, and wherein a first deflecting plate is disposed in the first channel and a third deflecting plate is disposed in the second channel such that the first deflecting plate and the third deflecting plate overlap.

* * * * *